US005586902A

United States Patent [19]

Hopf et al.

[11] Patent Number: 5,586,902

[45] Date of Patent: Dec. 24, 1996

[54] ELECTRIC CONNECTOR

[75] Inventors: Gustav Hopf, Schnaittach; Helmut Steinhardt, Nürnberg, both of Germany

[73] Assignee: Framatome Connectors International, Paris, France

[21] Appl. No.: 247,998

[22] Filed: May 24, 1994

[30] Foreign Application Priority Data

May 25, 1993 [DE] Germany ..... 43 17 344.6

[51] Int. Cl.[6] ..... H01R 13/73

[52] U.S. Cl. ..... 439/352; 439/685; 439/188

[58] Field of Search ..... 439/188, 352, 439/677, 680, 685, 689, 694, 620

[56] References Cited

U.S. PATENT DOCUMENTS

| | | | |
|---|---|---|---|
| 4,109,992 | 8/1978 | Hughes et al. | 439/685 X |
| 5,112,243 | 5/1992 | Chow et al. | 439/352 |
| 5,314,345 | 5/1994 | Cahaly et al. | 439/352 X |
| 5,425,653 | 6/1995 | Koiso | 439/352 X |

*Primary Examiner*—Khiem Nguyen

*Attorney, Agent, or Firm*—Pollock, Vande Sande & Priddy

[57] ABSTRACT

An electric connector, in particular between a generator and an electronic controller for inflatable motor vehicle airbags, with a connector housing for housing contact tubes with leads. In the coupling position, the connector housing lifts a jumper, disposed in a receptacle for the generator-sided plug pins, from the plug pins. To simplify the assembly and mount the connector reliably on the generator, the connector housing (1) has an assembly opening (2) which can be closed by a cover member (11) which is slidable over the assembly opening (2) and can be retained on the connector housing (1) by a pin (16), arranged in front of the cover member in the push-on direction. Guide elements (12, 13, 14, 15) are attached to the front and rear regions of the longitudinal sides, and which can be arrested at the connector housing (1) in a preclick-stop position and click-stop position by shoulders (21) on the longitudinal sides, and strip-shaped extensions (18), which reach in the click-stop position as the blocking element behind hook-shaped spring elements (19, 20), which are attached to the connector housing (1) and engage with recesses (24) of the generator (29), and prevent a return swing of the spring elements.

7 Claims, 3 Drawing Sheets

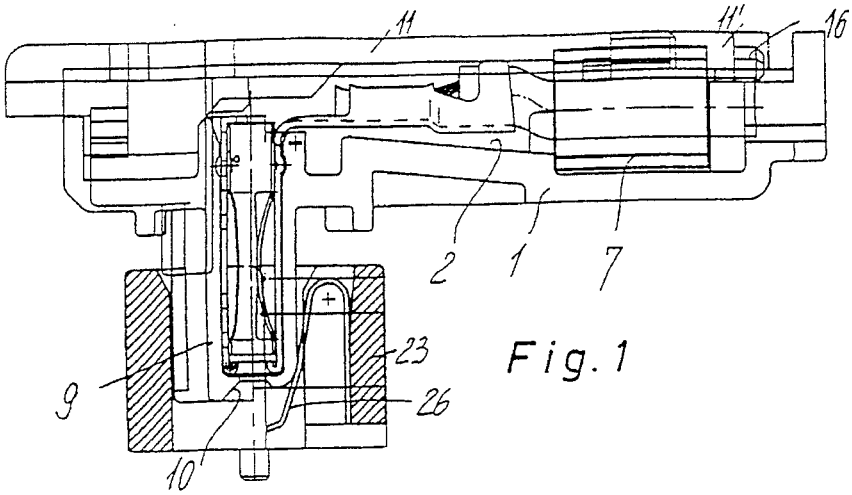
Fig. 1
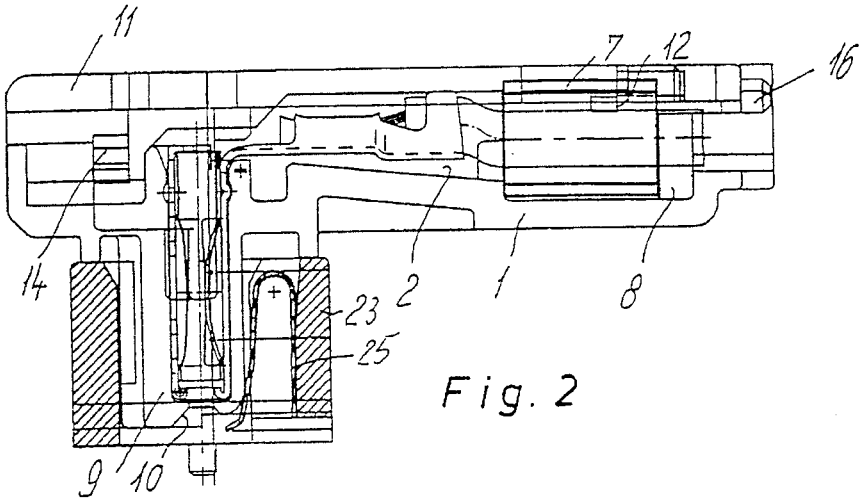
Fig. 2
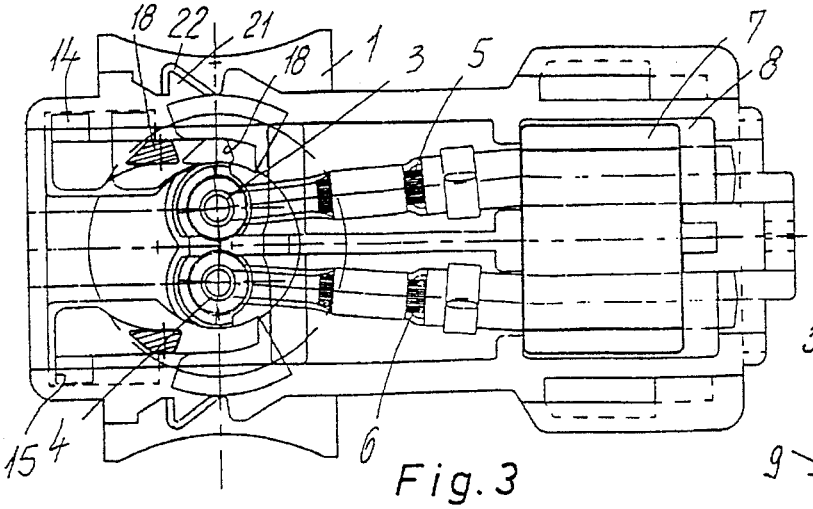
Fig. 3
Fig. 13
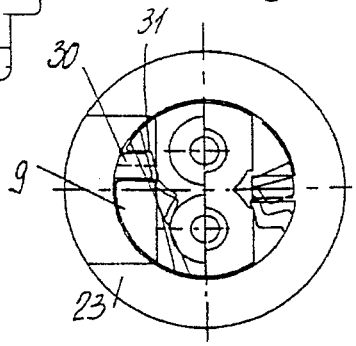

ELECTRIC CONNECTOR

FIELD OF THE INVENTION

The invention relates to an electric connector, in particular between a generator and an electronic controller for inflatable restraint systems (airbags) in motor vehicles, with a connector housing for housing the contact tubes with leads, where the connector housing in the coupling position lifts a jumper, disposed in a receptacle for the generator-sided plug pins, from the plug pins.

BACKGROUND OF THE INVENTION

Known connectors of the above class are used in ignition systems in order to prevent unwanted triggering of ignitions. They have the drawback that their designs are complicated, and that the connection between connector housing and ignition generator is unstable, thus enabling unintentional separations and preventing the ignition systems from functioning reliably.

SUMMARY OF THE INVENTION

The object of the invention is to provide a connector of simple construction and assembly, with reliable means for retaining it on the generator.

This problem is solved according to the invention in that the connector housing has an assembly opening which can be closed by means of a cover member, that the cover member can slide over the assembly opening and can be retained by means of a pin, arranged at the front of the cover member in the push-on direction, and guide elements, attached to the front and rear regions of the longitudinal sides, and can be arrested at the connector housing in both a preclick-stop position and a click-stop position by shoulders on the longitudinal sides, and strip-shaped extensions, which extend in the click-stop position as blocking elements behind hook-shaped spring elements attached to the connector housing and engaging in recesses of the generator, and thereby prevent a return swing of the spring elements. The connector housing can be provided in a simple manner with contact tubes and leads, while the dual function of the cover member assures that the connector housing is closed reliably and mounted on the generator, only a simple sliding movement of the cover member being required for these operations.

The receptacle provided with the jumper is constituted by a tube, which may or may not be mounted in a pre-fabricated state on the connector housing, e.g., a plug extension, and which can be attached together with the connector housing to the generator or formed separately from the connector housing directly on the generator.

The design of the connector provides that the projections are wedge-shaped and can be slid into successive saw-tooth shaped recesses, in the direction of displacement of the cover member in the connector housing. The front side of each projection may be in the form of an inclined plane; this results, subject to the influence of a component of the push-on force that acts on the inclined planes at right angles to the direction of displacement, in bending up of the corresponding generator parts. When these generator parts are then run over, they automatically snap in behind the projections.

The guide bodies are formed simply by strips and/or ribs and/or wedge elements, which are designed by grasping under the projections or by sliding in grooves. Finally, to prevent the formation of electric and/or magnetic fields in the region of the leads, the connector housing receives an electric attenuating element, which surrounds the contact tubes and is made, e.g., of ferrite material. The attenuating element may be in the shape of a prism, with passage openings for the leads.

BRIEF DESCRIPTION OF THE DRAWINGS

The invention will now be described with reference to the accompanying drawings, in which several embodiments are shown for purposes of illustration.

FIG. 1 shows a connector with a receptacle for a jumper in the separating position.

FIG. 2 shows a connector according to FIG. 1 in the coupling position.

FIG. 3 is a top plan view of an open connector.

FIG. 13 is a reduced bottom view of a plug extension with a tube.

DETAILED DESCRIPTION

Figure 7:
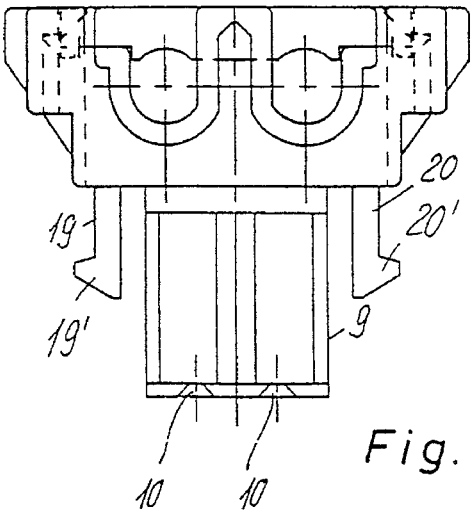
FIG. 7 is a front view of a connector.
Figure 11:
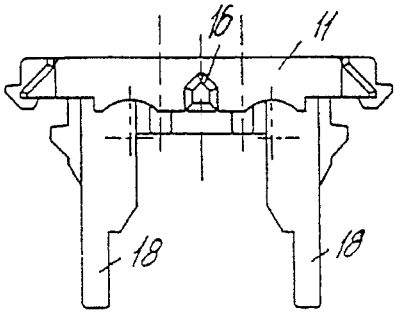
FIG. 11 is a front view of a cover member.

FIG. 1 shows a plastic connector housing 1 with an assembly opening 2 in the region of its upper side. Socket contacts 3 and 4, which are connected to leads 5 and 6, can be inserted into the connector housing via the assembly opening 2. The leads 5 and 6 are run through boreholes of an attenuating element 7 made of ferrite material, which is located in an extension 8 of the connector housing 1. The connector housing 1 is provided on its underside with a plug extension 9, into which the socket contacts 3 and 4 extend up to the vicinity of the plug openings 10. A cover member 11, which closes the assembly opening 2 of the plug housing 1, is provided with shoulders 12, 13, 14, and 15, which can be slid into guides of the connector housing 1 in order to hold the cover member 11 in position. In addition, the front end 11' of the cover member 11 comprises a pin 16, which fits into a hole 17 in the connector housing. Strip-shaped extensions 18, molded at the bottom to cover member 11, serve as blocking elements for spring elements 19, 20 (FIG. 7) on the connector housing.

Figure 4:
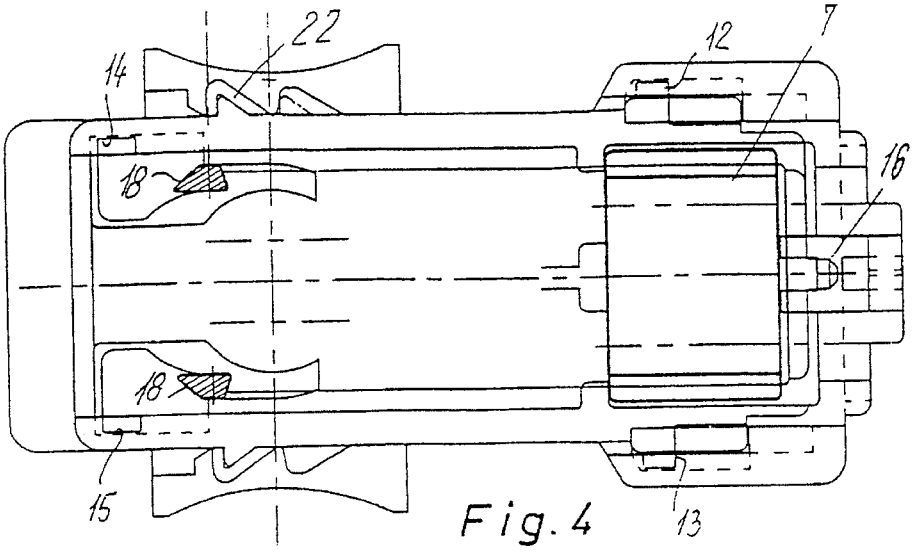
FIG. 4 depicts a connector that is open.
Figure 5:
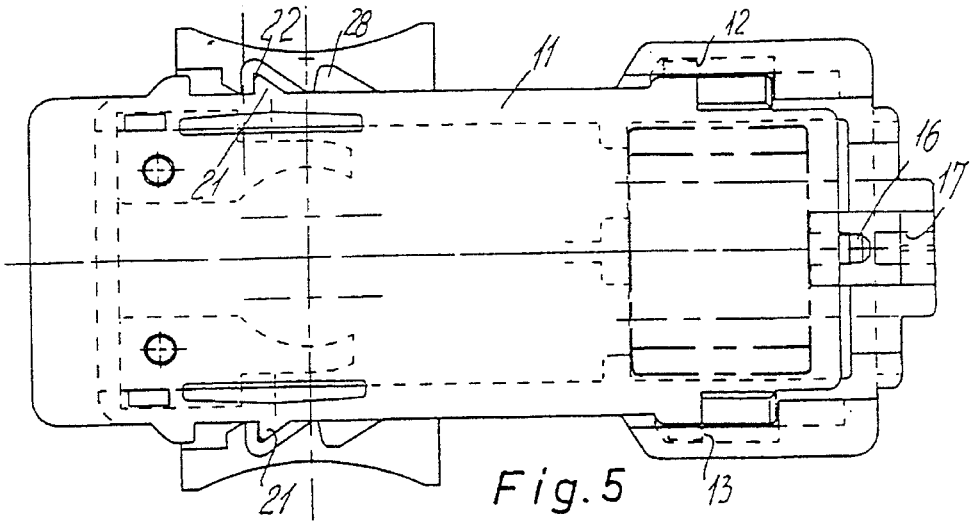
FIG. 5 is a top plan view of a connector with pre-click-stopped cover member.
Figure 6:
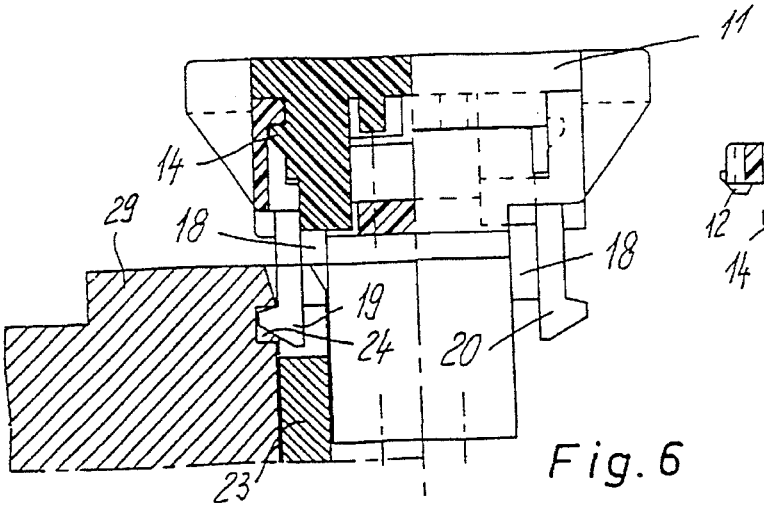
FIG. 6 is a partial view of a connector.
Figure 12:
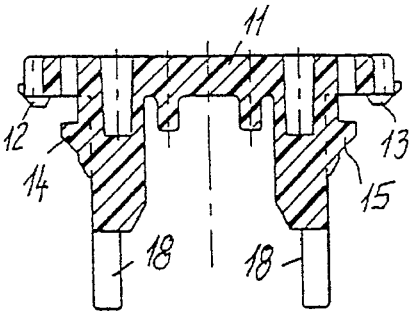
FIG. 12 is a sectional view along line XII—XII of FIG. IX.
Figure 8:
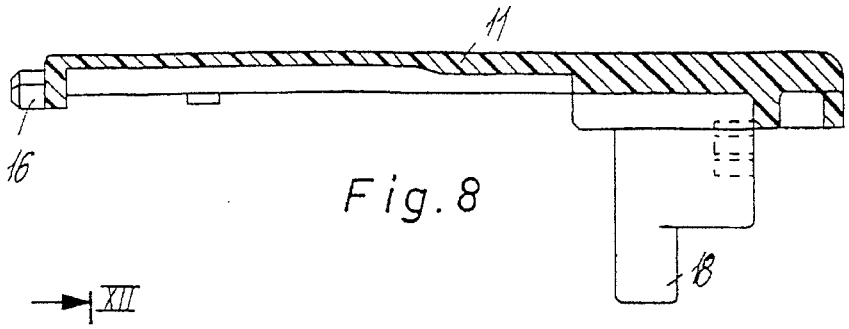
FIG. 8 is a sectional view of a cover member.
Figure 9:
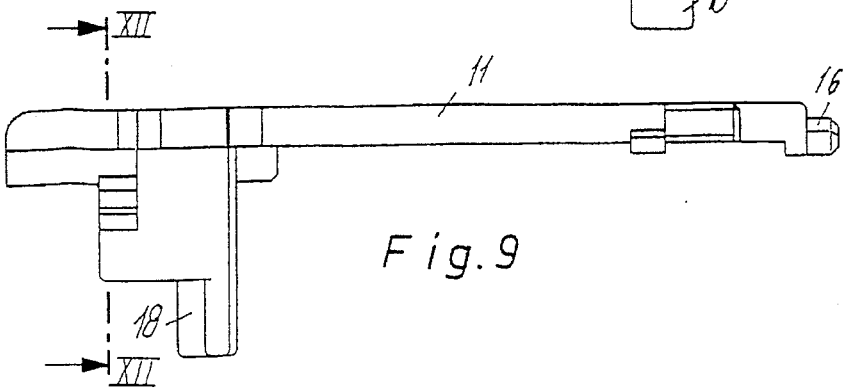
FIG. 9 is a side view of a cover member.
Figure 10:
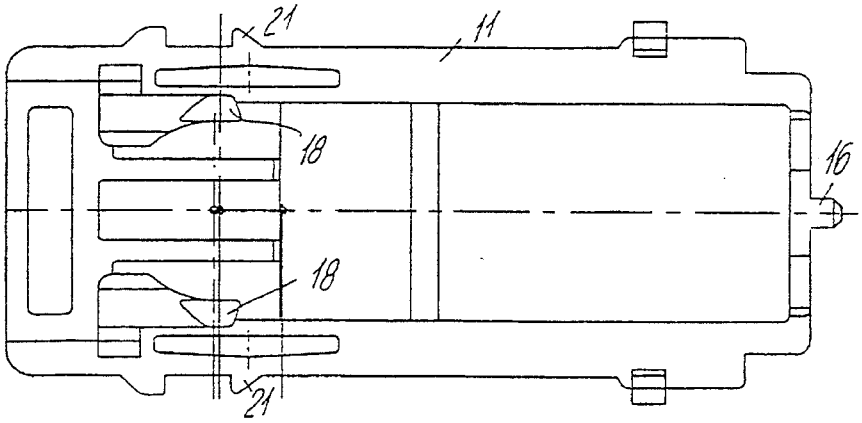
FIG. 10 is a top plan view of a cover member.

Following insertion of the socket contacts 3, 4 of the leads 5, 6 and the attenuating element 7, the cover member 11 can be slid into a pre-click-stop position onto the connector housing 1. In the pre-click-stop position, wedge-shaped projections 21 on the cover member 11 engage with recesses 22, which are arranged like successive saw teeth on the connector housing 1. In so doing, the extensions 18 assume the positions shown in cross-hatching in FIGS. 3 and 4. When the cover member 11 is pushed further, possibly after completed attachment of the connector housing 1 to a tube 23 of the generator 29, projections 21 move into the recesses 28 of the connector housing, these recesses forming a click stop position. At the same time the pin 16 extends into the hole 17 of the connector housing 1. Furthermore, the hook-shaped ends 19', 20' of the spring elements 19, 20 snap into recesses 24, causing the connector housing 1 to stop at the generator 29 and preventing the extensions 18, which have pushed themselves between the spring elements 19, 20 and the connector housing 1, from swinging back unintentionally.

The tube 23 receives a jumper 25, whose spring tongues 26 rest against the plug pins (not shown) attached to the generator 29 prior to depositing the plug housing 1 on the generator 29. As soon as the connector housing 1 is attached to the generator 29, the plug extension 9 pushes itself into the tube 23. In so doing, the socket contacts 3, 4 interact with the plug pins of the generator 29, and, as shown in FIG. 2, during the subsequent plugging action the spring tongues 26 of the jumper 25 are pivoted outwardly by means of the plug extension 9 so as to release the plug pins.

As shown in FIG. 13, the robe 23 is provided with a coding extension 30, which engages a groove-shaped recess 31 in the plug extension 9.

We claim:

1. Electric connector between a generator and an electronic controller for housing socket inflatable motor vehicle airbags, said connector comprising a housing for contact tubes with leads, wherein said housing in a coupling position lifts a jumper, disposed in a receptacle for generator-sided plug pins, from said plug pins, said housing further comprising hook-shaped spring elements attached to said housing, and engaging with recesses in said generator, said connector being provided with a cover member having strip-shaped extensions, constituting a click-stop position blocking said hook-shaped spring elements, wherein the connector housing has an assembly opening closed by a cover member retained on said housing by a pin arranged in front of said cover member in a push-on direction, and by guide elements, attached to front and rear regions of longitudinal sides of said cover member, said cover member being slidable over said assembly opening of said housing in a direction parallel to an upper surface of said connector, from a preclick-stop position to said click-stop position by means of projections provided on said longitudinal sides.

2. Connector as claimed in claim 1, wherein the connector housing carries an electric attenuating element surrounding leads to socket contact tubes.

3. Connector as claimed in claim 2, wherein said electric attenuating element is made of a ferrite material, for electrical or magnetic fields that build up in the region of said leads.

4. Connector as claimed in claim 1, wherein the guide elements are constituted by strips or ribs or wedge elements.

5. Connector as claimed in claim 1, wherein the receptacle containing said jumper is a tube receiving a plug extension that is stationary in the connector housing.

6. Connector as claimed in claim 5, wherein the plug extension has a groove-shaped recess, which together with a shoulder rigidly attached to the tube forms a coding between the connector housing and the tube.

7. Electric connector between a generator and an electronic controller for inflatable motor vehicle airbags, said connector comprising a housing for contact tubes with leads, wherein said housing in a coupling position lifts a jumper, disposed in a receptacle for generator-sided plug pins, from said plug pins, said housing further comprising hook-shaped spring elements attached to said housing, and engaging with recesses in said generator, said connector being provided with a cover member having strip-shaped extensions, constituting a click-stop position blocking said hook-shaped spring elements, wherein the connector housing has an assembly opening closed by a cover member retained on said housing by a pin arranged in front of said cover member in a push-on direction, and by guide elements, attached to front and rear regions of longitudinal sides of said cover member, said cover member being slidable over said assembly opening of said housing in a direction parallel to an upper surface of said connector, from a preclick-stop position to said click-stop position by means of projections provided on said longitudinal sides, wherein the projections are wedge-shaped and can be slid into successive sawtooth recesses, respectively forming preclick-stop and click-stop positions in the push-on direction of the cover member in the connector housing.

* * * * *